US009265350B2

(12) United States Patent
Davotian

(10) Patent No.: US 9,265,350 B2
(45) Date of Patent: Feb. 23, 2016

(54) FURNITURE WITH A STRUCTURAL FRAME WHICH RECEIVES ONE OR MORE REPLACEABLE SECTIONS

(71) Applicant: Henry Davotian, Glendale, CA (US)

(72) Inventor: Henry Davotian, Glendale, CA (US)

( * ) Notice: Subject to any disclaimer, the term of this patent is extended or adjusted under 35 U.S.C. 154(b) by 0 days.

(21) Appl. No.: 14/276,764

(22) Filed: May 13, 2014

(65) Prior Publication Data

US 2015/0159686 A1 Jun. 11, 2015

Related U.S. Application Data

(60) Provisional application No. 61/824,577, filed on May 17, 2013.

(51) Int. Cl.

| | |
|---|---|
| ***A47C 4/00*** | (2006.01) |
| ***A47C 19/00*** | (2006.01) |
| ***A47B 13/00*** | (2006.01) |
| ***A47C 4/02*** | (2006.01) |
| ***A47C 7/02*** | (2006.01) |
| ***A47C 7/42*** | (2006.01) |

(52) U.S. Cl.

CPC ..... *A47C 19/005* (2013.01); *A47B 13/003* (2013.01); *A47C 4/02* (2013.01); *A47C 7/02* (2013.01); *A47C 7/425* (2013.01); *Y10T 403/70* (2015.01)

(58) Field of Classification Search

CPC ..... A47C 19/00; A47C 4/00
USPC ..... 5/239, 236.1, 237, 400, 2.1
See application file for complete search history.

(56) References Cited

U.S. PATENT DOCUMENTS 4,617,689 A * 10/1986 Nelson et al. ..... 5/400
8,079,315 B2 * 12/2011 Berent et al. ..... 108/158.12

* cited by examiner

*Primary Examiner* — Fredrick Conley
(74) *Attorney, Agent, or Firm* — Lewis Roca Rothgerber Christie LLP

(57) ABSTRACT

Furniture having a structural frame with at least one pair of opposing u-shaped rails adapted to receive a replaceable section that is slid into the rails and supported by the rails and one or more slats. The replaceable section can, optionally, be locked in place once it has been inserted. Because a replaceable section easily slides into its u-shaped rails, it is quick and easy to replace such sections, which can be made of less expensive and less sturdy construction than the solid structural frame.

12 Claims, 4 Drawing Sheets

FURNITURE WITH A STRUCTURAL FRAME WHICH RECEIVES ONE OR MORE REPLACEABLE SECTIONS

CROSS REFERENCE TO RELATED APPLICATIONS

This application claims priority from U.S. Ser. No. 61/824,577, of the same title, filed May 17, 2013, the disclosure of which is specifically incorporated herein be reference in its entirety.

FIELD OF THE INVENTION

The present invention is in the field of furniture.

BACKGROUND OF THE INVENTION

Furniture can be bought already assembled or with the need for assembly. Once furniture is assembled, unless it is modular furniture, it often remains in its assembled state with little change. Sometimes furniture is reupholstered or a slip covering or other device is place over it, but the former involves a considerable amount of work and the latter is very obviously transitory.

SUMMARY OF THE INVENTION

The present invention is generally directed to furniture that has a solid structural frame containing at least one pair of opposing u-shaped rails which are adapted to receive a replaceable section that is slid into the rails and supported by the rails and one or more slats. The replaceable section can, optionally, be locked in place once it has been inserted. Because a replaceable section easily slides into its u-shaped rails, it is quick and easy to replace such sections, which can be made of less expensive and less sturdy construction than the solid structural frame.

Accordingly, it is a primary object of the present invention to provide furniture with a structural frame which receives one or more replaceable sections.

This and further objects and advantages will be apparent to those skilled in the art in connection with the drawings and the detailed description of the preferred embodiment set forth below.

BRIEF DESCRIPTION OF THE DRAWINGS

FIG. 1 illustrates a chair in accordance with the present invention while

FIG. 3 illustrates a portion of a rail useful in the present invention while

DETAILED DESCRIPTION OF THE INVENTION

The present invention is generally directed to furniture in which a structural base element contains one or more opposing rails adapted to receive a flat replaceable section that slides into, and is held by, the one or more opposing rails. The replaceable section can quickly and easily be inserted into the opposing rails, and no tools are required to make such insertion.

Figure 1:
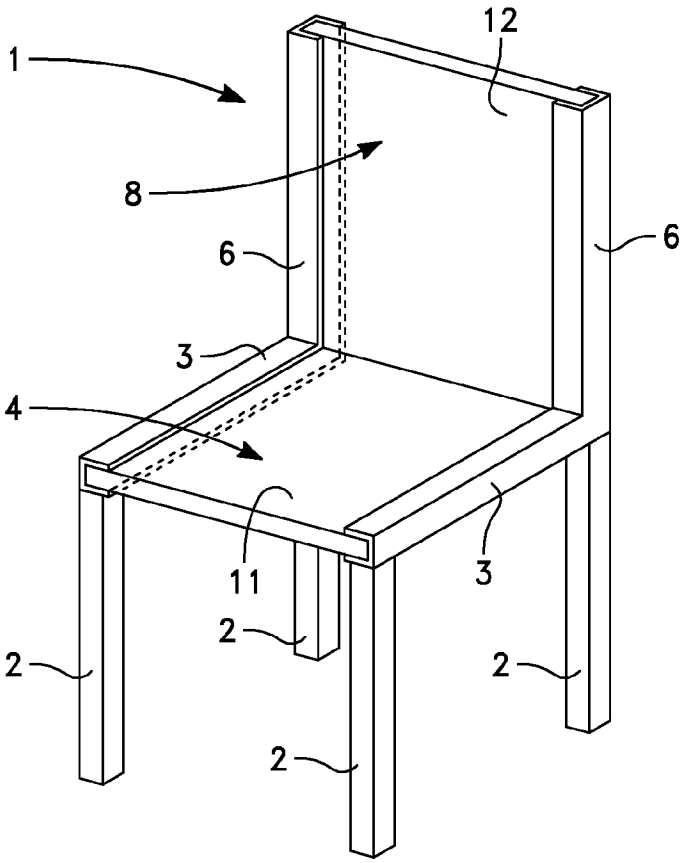

FIG. 1 illustrates a chair in accordance with the present invention. Chair 1 has four legs 2 that are connected to two u-shaped rails 3 that oppose each other so that their u-shapes will receive a base section 4 as illustrated in FIG. 1. (Note that while the surface of base section 4 upon which a user sits is depicted as being flat, for illustrative purposes, in the drawings, such surface might be padded or contoured, as is common in the art.) Three horizontal slats 5 extend between and underneath u-shaped rails 3 to provide structural rigidity and support for the chair (see FIG. 2). The back of chair 1 has two back supports 6 extending up from the rear legs 2 which form their own u-shaped back rails 7 that oppose each other so that their u-shapes will receive a back rest section 8 as illustrated in FIG. 1. Three vertical slats 9 extend between and behind u-shaped back rails 7 to provide structural rigidity and support for the back of chair 1 (see FIG. 2).

Figure 2:
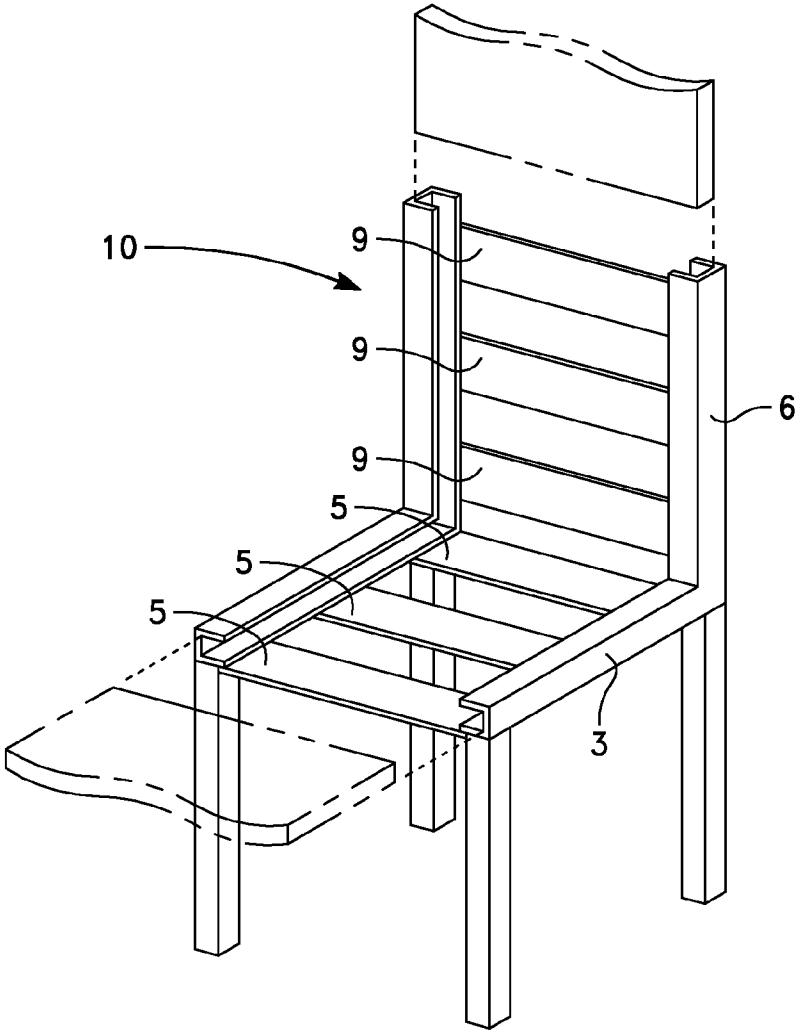
FIG. 2 illustrates the structural frame of the chair in FIG. 1 with it replaceable section base and back sections removed.

The structural frame 10 of chair 1 is shown in FIG. 2 and all of its elements can be integrally joined together to form a solid structural chair only lacking base section 4 and back rest section 8. In an especially preferred embodiment, structural frame 10 of chair 1 is made of metal, although it can also be made of wood or plastic.

Base section 4 and back rest section 8 can be made of any suitable material, including plastic, polyurethane and padded materials.

Base section 4 is added to structural frame 10 by sliding it into the two u-shaped rails 3 where it is held between the two u-shaped rails 3 and supported by horizontal slats 5. Back rest section 8 is added to structural frame 10 by sliding it into the two u-shaped rails 6 where it is held between the two u-shaped rails 6 and supported by vertical slats 9. No special tools are required for such operations which are simple, quick and easy to accomplish Either or both of base section 4 and back rest section 8 can be adapted to include a locking mechanism for securing the section in place when it is fully inserted into the two u-shaped rails that will hold it. However, it is especially desirable that any such locking mechanism be quick, easy and simple, so that it does not detract from the elegant simplicity of the construction already described. For example, one or both sides of each section could have a retractable male member (not shown) that is biased outwardly by a spring that engages with a corresponding female member (hole, also not shown) located in a u-shaped rail such that the retractable male member will be in a retracted position as it is being slid along a u-shaped rail until it reaches a desired final location with a hole into which the retractable male member would then extend to form a lock which can then be undone by applying pressure on the extended male member to cause it to retract against the tension of its spring. Another locking mechanism could be end caps or end sections that are fitted to the base section and/or back rest portion and their corresponding u-shaped rails once the base section and/or back rest portion are fully inserted into their u-shaped rails. Other additional locking mechanisms are also possible.

A chair constructed according to the present invention has many advantages. It is easy to manufacture and long-lasting because the structural frame can be made very solidly while the parts that receive the most wear, namely base section 4 and back rest portion 6, can easily be replaced, so they can be made of less expensive materials. Also, the replaceable sections might be changed to change the look of chair 1. For example, one back rest section 6 might be a short back while another might extend further for a more elegant look. Alternatively, the replaceable sections can be made of different materials having different designs and colors, so that replacing one or both sections could easily change the overall look of the chair. Also, multiple replaceable sections could be sold in kits for use with a single structurally frame.

Figure 3:
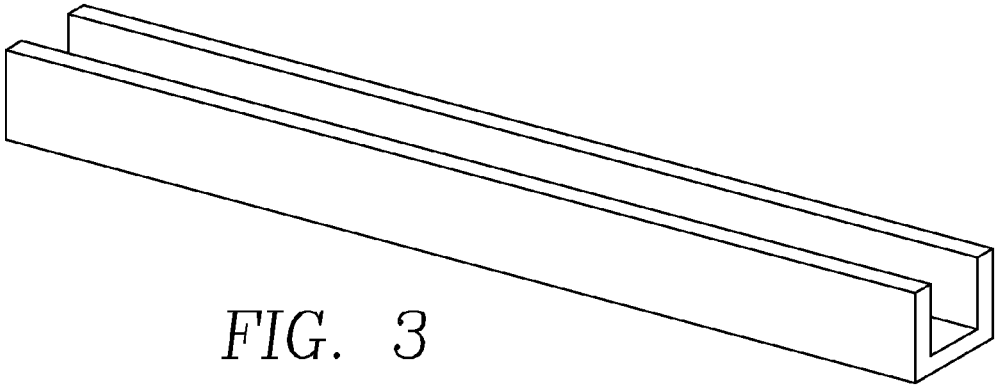
Figure 3A:
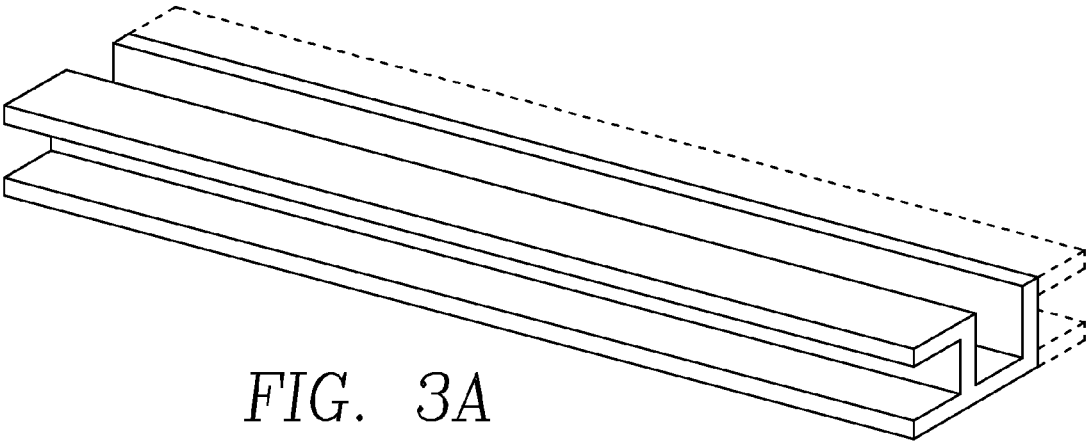
FIGS. 3A and 3B illustrate alternative rails useful in the present invention.
Figure 3B:
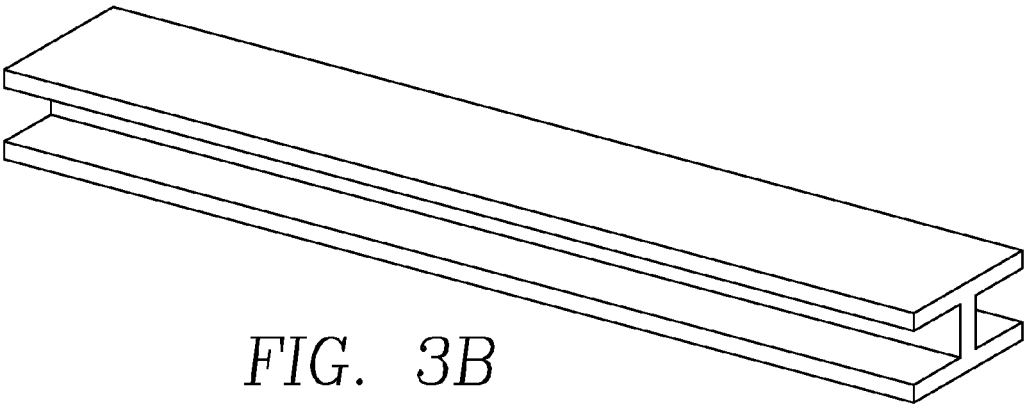

The invention has been described as having u-shaped rails, a portion of which is shown in FIG. 3. It should be noted that while such shape is especially preferred, the invention is not solely limited to such shape, and other shapes that accomplish the same function can also be used. What is important is that the replaceable section(s) can quickly and easily be inserted into, and removed from, the structural frame without the use of tools and without needing any assembly, or a minimum amount of assembly, and without the need for following self-assembly instructions that many consumers have come to loathe because such "simple" instructions are often anything but, which can lead to great frustration and ill will. Similarly, while it is especially preferred that the u-shaped rails be continuous as shown in FIG. 2, the invention is not so limited, and portions of the rails might have gaps without departing from the spirit and scope of the present invention.

Figure 4:
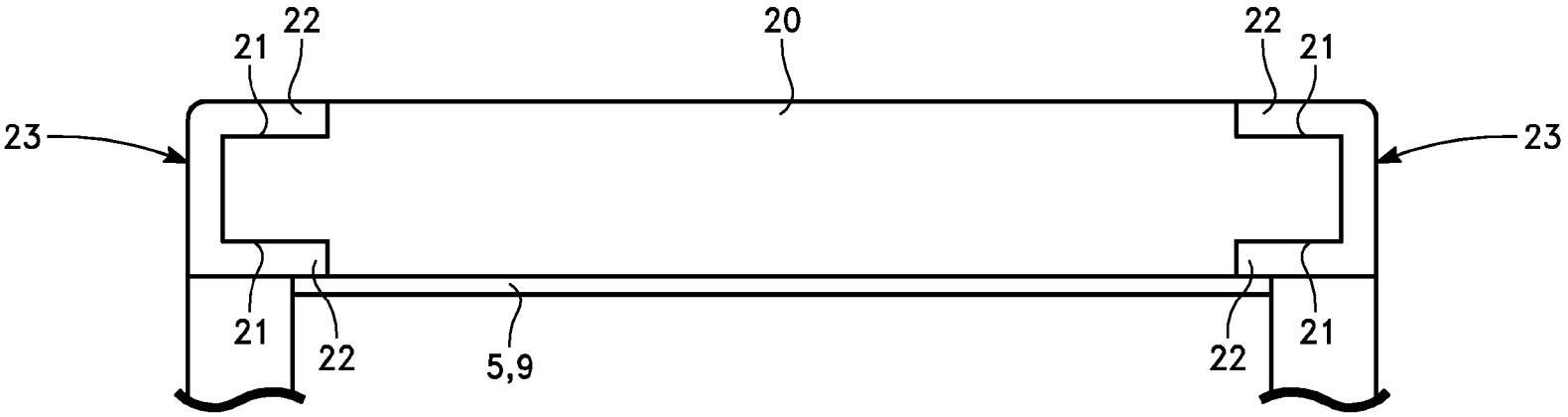
FIGS. 4 and 4A are cross sectional views of two embodiments of the present invention illustrating flush surfaces of a replaceable section fitted to a pair of rails in accordance with the present invention.
Figure 4A:
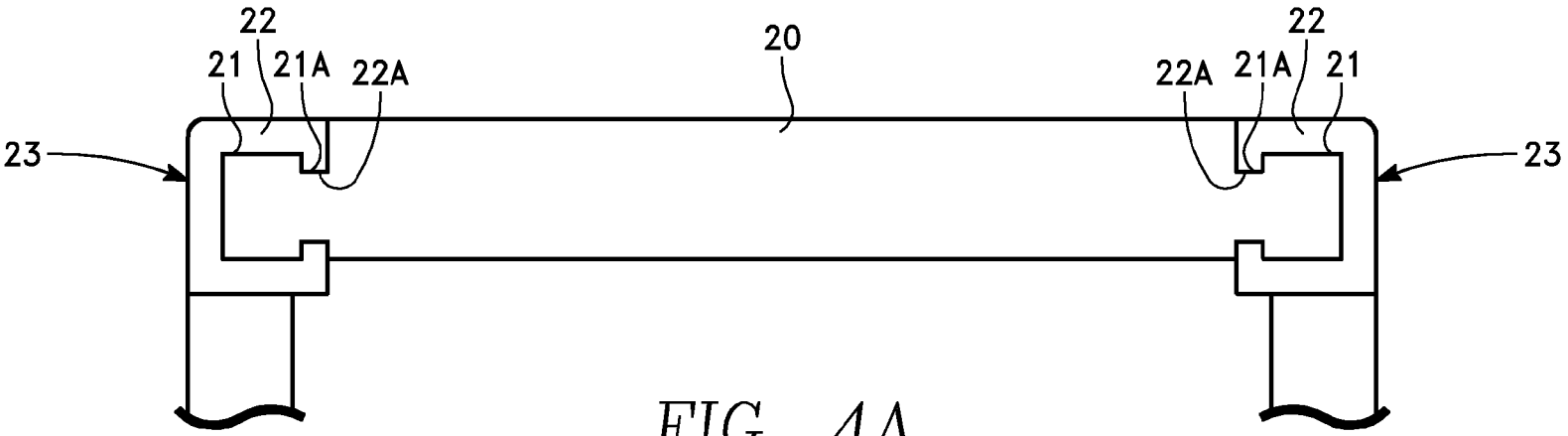

It is also especially preferred, though not always required, that the removable sections be constructed so that one or both surfaces of the removable sections are substantially flush with the u-shaped rails (this would be most important for the top surface 11 of base section 4 and the forward surface 12 of back rest section 8). This concept is illustrated in FIGS. 4 and 4A. As shown in FIG. 4, a replaceable section 20 (which could be a base section 4 or a back rest section 8) can have indented sections 21 that are designed to accommodate the cross section thickness 22 of u-shaped rails 23 (the dimensions have been exaggerated for illustrative purposes). FIG. 4A illustrates an alternative embodiment in which a c-shaped rail is used in the same fashion as the u-shaped rail already described. It should also be noted that when a bottom surface of the removable structure is meant to rest on one or more slats, there should be contact between such slat(s) and the bottom surface as is shown in FIG. 4 in which replaceable section 20 is both flush with the u-shaped rails as well as slats 5, 9.

So far the present invention has been described by reference to a chair. The concepts already disclosed for a chair can be used for other pieces of furniture, such as tables (e.g., a coffee table, end table or sofa table), a head board for a bed, a dresser, a multi-drawer chest and even a dining room table and chair set. In each such piece of furniture, a structural frame will have at least one set of u-shaped rails adapted to receive a replaceable section that will be received within a pair of u-shaped rails and supported by one or more, and preferably a plurality of, slats.

Figure 5:
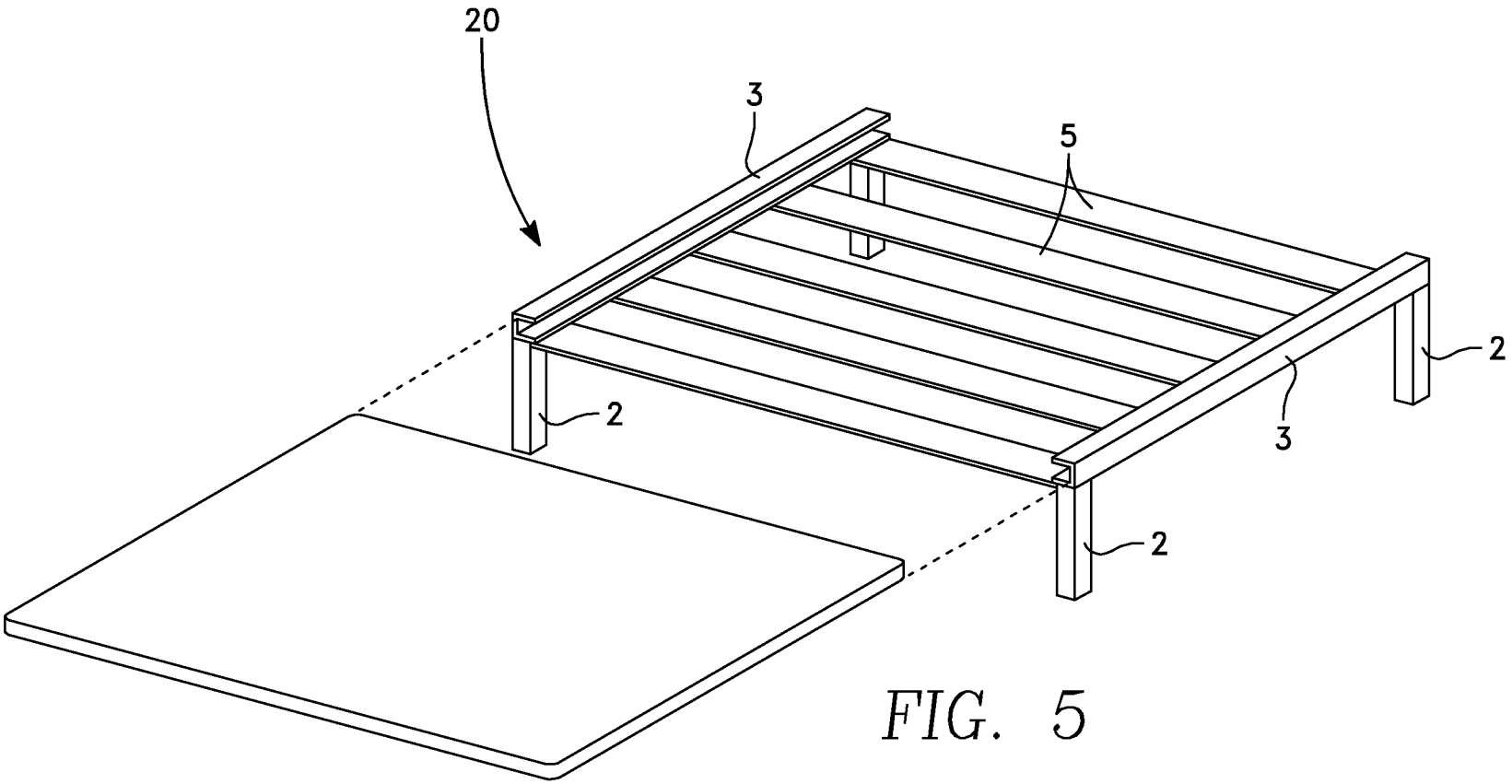
FIG. 5 illustrates a coffee table in accordance with the present invention.

FIG. 5 illustrates a structural frame 20 for a table, such as a coffee table. It has four legs 2, a pair of horizontal u-shaped rails 3 and a plurality (six are shown in FIG. 5) of horizontal slats 5. To complete a table, a table top (which can be of any suitable material, including glass) is slid into the horizontal u-shaped rails 3 in the same fashion and manner that base section 4 is slid into structural frame 10 of chair 1.

Although the foregoing detailed description is illustrative of preferred embodiments of the present invention, it is to be understood that additional embodiments thereof will be obvious to those skilled in the art. For example, a bed can be designed so that the head board and the foot board are both removable vertically, in a fashion similar to removing the back of a chair. Also, like a chair, the support for the bed can have slats. In addition, additional pairs of rails can be used on each side to create decorative side rails. Moreover, the frame just described for a bed can be constructed so that it attaches to standard metal stand alone bed frames that have no head board, foot board or decorative side boards, and such an embodiment offers many decorative and design possibilities. Further modifications are also possible in alternative embodiments without departing from the inventive concept.

Accordingly, it will be readily apparent to those skilled in the art that still further changes and modifications in the actual concepts described herein can readily be made without departing from the spirit and scope of the disclosed inventions.

What is claimed is:

1. A method for customizing a piece of furniture, comprising the steps of:

removing a first support piece from u-shaped or c-shaped channels of a pair of opposed side rails in the piece of furniture by sliding the first support piece out of the u-shaped or c-shaped channels without disassembling the opposed side rails; and replacing the first support piece with a second support piece by sliding the second support piece into the u-shaped or c-shaped channels of the pair of opposed side rails, wherein both the first support piece and the second support piece are held within the pair of opposed side rails along entire opposed edge surfaces and are interchangeable without disassembling the piece of furniture.

2. A piece of furniture comprising:

a structural support for the piece of furniture, said structural support including a pair of opposed side rails having a u-shaped or c-shaped channel extending along an entire length of the opposed rails; and a removable support piece for insertion into the pair of opposed side rails in the u-shaped or c-shaped channel;

wherein entire opposed edge surfaces of the removable support piece are removably held within the u-shaped or c-shaped channel of the pair of opposed side rails to create a replaceable section of the piece of furniture without having to disassemble the piece of furniture.

3. The piece of furniture of claim 2, wherein the piece of furniture is comprised of a chair.

4. The piece of furniture of claim 2, wherein the piece of furniture is comprised of a table.

5. The chair of claim 4, wherein the opposing back rails have a c-shaped or u-shaped channel extending an entire length of the back support structure for containing entire opposed side edges of the chair back.

6. The piece of furniture of claim 2, wherein the piece of furniture is comprised of a bed frame.

7. The piece of furniture of claim 6, wherein the bed frame includes a mattress support section.

8. The piece of furniture of claim 6, wherein the bed frame includes a head board section and a foot board section.

9. The piece of furniture of claim 8, wherein the bed frame has a pair of side board sections.

10. A chair, comprising:

a seat support structure for holding a seat, said seat support structure including a pair of opposing seat rails having a c-shaped or u-shaped channel extending an entire length of the seat support structure for receiving entire opposed side edges of the seat;

the seat is removeable and can slide into and out of the pair of opposing seat rails, said pair of opposing seat rails holding the entire opposed side edges of the seat when it is inserted into the c-shaped or u-shaped channel of the pair of opposing rails;

a back support structure for holding a chair back, said back support structure being affixed to the seat support structure, said back support structure including a pair of opposing back rails for receiving the chair back when it is inserted into the pair of opposing back rails; and the chair back is removable and can slide into and out of the pair of opposing back rails;

wherein the seat and the chair back are removeable without disassembling the seat support structure or the back support structure.

11. The chair of claim 10, further comprising one or more slats affixed to the seat support structure for supporting the seat.

12. The chair of claim 10, wherein an upper seat portion of the removable seat is substantially flush with an upper seat rail portion of the pair of opposing seat rails.

* * * * *